US012013128B2

(12) United States Patent
Acosta Herrero et al.

(10) Patent No.: US 12,013,128 B2
(45) Date of Patent: Jun. 18, 2024

(54) GAS HOB

(71) Applicant: BSH Hausgeräte GmbH, Munich (DE)

(72) Inventors: Luis Acosta Herrero, Maliaño (ES); Melca Gutierrez Humara, La Penilla (ES); Philipp Kleinlein, Munich (DE); Alberto Lopez Ortiz, Santander (ES); Alexander Marsch, Feldkirchen-Westerham (DE); Luis Antonio Palacios Valdueza, Astillero (ES); Carlos Pelayo Alonso, Villafufre (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 266 days.

(21) Appl. No.: 17/437,062

(22) PCT Filed: Mar. 18, 2020

(86) PCT No.: PCT/EP2020/057395
§ 371 (c)(1),
(2) Date: Sep. 8, 2021

(87) PCT Pub. No.: WO2020/193300
PCT Pub. Date: Oct. 1, 2020

(65) Prior Publication Data

US 2022/0163210 A1 May 26, 2022

(30) Foreign Application Priority Data

Mar. 25, 2019 (ES) ..... ES201930270

(51) Int. Cl.
*F24C 3/00* (2006.01)
*F23K 5/00* (2006.01)
(Continued)

(52) U.S. Cl.
CPC ..... *F24C 3/008* (2013.01); *F23K 5/005* (2013.01); *F23K 5/007* (2013.01); *F24C 3/085* (2013.01);
(Continued)

(58) Field of Classification Search
CPC ..... F23K 5/007; F23K 5/005; F24C 15/2042
(Continued)

(56) References Cited

U.S. PATENT DOCUMENTS 2,480,046 A * 8/1949 Reeves ..... F24C 15/10 126/214 C
5,325,842 A * 7/1994 Beach ..... F24C 3/126 126/300
(Continued)

FOREIGN PATENT DOCUMENTS

CA 3057918 A1 5/2016
CN 206160207 U 5/2017
(Continued)

OTHER PUBLICATIONS

National Receipt Search Report ES 201930270 dated Oct. 21, 2019.
International Receipt Search Report PCT/EP2020/057395 dated May 27, 2020.

*Primary Examiner* — Vivek K Shirsat
(74) *Attorney, Agent, or Firm* — Michael E. Tschupp; Andre Pallapies; Brandon G. Braun

(57) ABSTRACT

A gas hob comprising a top sheet, a port, a gas burner arranged on the top sheet and releasably connected to the port the port being configured to supply the gas burner with fuel gas, and an extraction unit configured to extract fumes, the extraction unit being retractable into the top sheet.

19 Claims, 8 Drawing Sheets

(51) Int. Cl.
*F24C 3/08* (2006.01)
*F24C 15/10* (2006.01)
*F24C 15/20* (2006.01)

(52) U.S. Cl.
CPC ..... *F24C 15/107* (2013.01); *F24C 15/2042* (2013.01); *F24C 15/2092* (2013.01)

(58) Field of Classification Search
USPC ..... 126/39 E, 39 R
See application file for complete search history.

(56) References Cited

U.S. PATENT DOCUMENTS

| | | | | |
|---|---|---|---|---|
| 7,881,593 | B2 | 2/2011 | Grassi | |
| 2008/0029081 | A1* | 2/2008 | Gagas | F24C 15/2042 126/299 D |
| 2012/0204855 | A1* | 8/2012 | Huber | F24C 15/2092 126/299 R |
| 2014/0137853 | A1 | 5/2014 | Murray | |
| 2015/0330641 | A1* | 11/2015 | Lillesand | F24C 15/2042 126/299 D |
| 2015/0338090 | A1 | 11/2015 | Song | |
| 2018/0073745 | A1 | 3/2018 | Norman | |

FOREIGN PATENT DOCUMENTS

| | | | |
|---|---|---|---|
| EP | 3015773 | A1 | 5/2016 |
| WO | 2004088207 | A1 | 10/2004 |

* cited by examiner

GAS HOB

CROSS-REFERENCES TO RELATED APPLICATIONS

This application is the U.S. National Stage of International Application No. PCT/EP2020/057395, filed Mar. 18, 2020, which designated the United States and has been published as International Publication No. WO 2020/193300 A1 and which claims the priority of Spanish Patent Application, Serial No. P201930270, filed Mar. 25, 2019, pursuant to 35 U.S.C. 119(a)-(d).

BACKGROUND OF THE INVENTION

The present invention relates to a gas hob.

A gas hob typically comprises a top sheet and gas burners. A respective gas burner is associated with a gas valve for providing fuel gas. The gas valve is typically provided below the top sheet. The fuel gas is mixed with primary air to obtain a flammable gas/air mixture which is burnt at openings of the gas burner. A respective pan support for supporting a pan or pot is associated with each gas burner.

CN206160207U discloses a modular gas hob with a number of gas burners and burner modules, wherein one gas burner is connected to one burner module. The gas burners are provided with fuel gas via the burner modules. If the gas hob is not in use, the gas burners can be disconnected from the burner modules.

BRIEF SUMMARY OF THE INVENTION

It is one object of the present invention to provide an improved gas hob.

Accordingly, a gas hob is provided comprising a top sheet, a port, a gas burner arranged on the top sheet and releasably connected to the port, the port being configured to supply the gas burner with fuel gas, and an extraction unit configured to extract fumes, the extraction unit being retractable into the top sheet.

The gas hob may be configured in accordance with user requirements. For example, when the user is not busy cooking on the gas burner, the gas burner can be disconnected from the port and stowed away. Also, the extraction unit can be brought into its retracted state. Thus, the top sheet is readily available to do kitchen work, for example chopping ingredients or other preparation work, not requiring a hot flame. Once a hot flame is required, the gas burner is connected to the port and the extraction unit is brought into its extended state. Now, food can be prepared in a pan or other cooking vessel on the gas burner's open flame.

The top sheet can be made of metal, glass, ceramic and/or glass-ceramic. The top sheet may also be of the same material as a common kitchen worktop, e.g. stone (in particular granite). Thus, the top sheet can be a kitchen worktop and/or a cooking zone of a continuous kitchen work top.

That the gas burner is releasably connected to the port herein relates to a fluid connection which can be established (connected), i.e. fluid may flow from the port to the gas burner, and released (disconnected), i.e. fluid may not flow from the port to the gas burner. "Fluid" refers to a gas, in particular. The fluid connection may also include a mechanical connection comprising engaging elements engaging each other such as recesses, protrusions, pins, hooks, threads, screws etc. The port may comprise an injector for injecting fuel gas into the gas burner, in particular into a pipe or venturi portion thereof. The port may be configured such that, when no gas burners connected thereto, it prevents any fuel gas from escaping.

The extraction unit may be configured to be retractable partially or completely into the top sheet. In the retracted state, at least a portion of the extraction unit may be arranged underneath the top sheet. Similarly, the extraction unit may be configured to be extendable partially or completely above the top sheet. In the extended state, at least a portion of the extraction unit may be arranged above the top sheet. Herein, the extraction unit comprises at least an opening (e.g., channel, hole, slit or the like) to draw in fumes generated in the cooking area such as fumes from cooking or burnt food. Said opening may be formed by a metal housing, for example. The extraction unit may comprise one or more filter elements configured to filter out particles, fat, soot et cetera. The extraction unit may comprise a housing having the opening and/or the filter elements. Further, the extraction unit may comprise means to generate a vacuum such as an electric motor driving a fan. However, it may be preferable to arrange such vacuum generating means in a location below the top sheet and connected fluidly to the extraction unit, for example by means of a tube or pipe.

According to an embodiment, the extraction unit is a downdraft extraction unit.

The downdraught extraction unit is configured to draw fumes from the cooking area into an area below the top sheet.

According to a further embodiment, the top sheet and the extraction unit, in its retracted state, form a flat surface.

This allows to provide a flat working surface formed by the top sheet and the retracted extraction unit, which can then be used in other ways. For example, it is possible to do kitchen work on the top sheet before cooking—unhindered by an uneven surface. After cooking, the surface can be easily cleaned. A flat surface especially means that the upper side of the extraction unit is flush with the top sheet in its retracted state.

According to a further embodiment, the gas hob comprises means configured to retract the extraction unit into the top sheet.

Such means may include a pneumatic system and/or a mechanical system and/or an electronical system. In particular, such means include an electric motor and/or a controller, for example a microprocessor, controlling the system, in particular the electric motor, to retract and/or extend the extraction unit. Alternatively, the extraction unit may be retracted and/or extended by hand.

According to a further embodiment, the gas hob further comprises a connection rail having a plurality of ports and a plurality of gas burners arranged on the top sheet and releasably connected to the ports, the ports being configured to supply the gas burners with fuel gas.

The gas hob comprises, preferably, a single connection rail to connect all gas burners. For example, 2, 3, 4, 5, 6 or more ports (to supply gas) and corresponding gas burners are provided. The fuel gas and the primary air may be mixed directly at each of the gas burners, within the connection rail or below the top sheet using, e.g., a venturi portion and an injector. Preferably, the gas hob is configured such that the user can choose to, at any time, connect a single gas burner to one port, some gas burners to some ports or a gas burner to every port.

The connection rail is, preferably, an elongated element whose length is, for example, at least twice its width. For example, the connection rail may have a bar shape. The connection rail may have a rectangular or square cross-section. The connection rail may be made, at least partially, of metal. The gas burners may be detached therefrom when they are not in use. If a gas burner is not connected to a specific port, said port is designed to prevent an emission of fuel gas—especially when some ports are connected to a respective gas burner and some ports are not.

According to a further embodiment, the extraction unit is arranged on top of and/or at least partially inside the connection rail.

According to a further embodiment, the extraction unit and the connection rail are fixedly connected to each other.

For example, the extraction unit and the connection rail may each comprise a housing. Said housings may be connected to each other fixedly. Alternatively, there may be provided a single housing comprising the extraction unit and the connection rail.

According to a further embodiment, the extraction unit is retractable into the connection rail.

For example, the connection rail may comprise, on its upper side (also termed "top surface" herein), an opening. In its retracted state, the extraction unit is at least partially or completely arranged inside said opening. In its extended state, the extraction unit extends through the opening upwards above the upper side of the connection rail.

According to a further embodiment, the connection rail is retractable into the top sheet.

In this way, additional working space can be created when the gas hob is not in use. In addition, the surface of the top sheet can be easily cleaned.

According to a further embodiment, the ports are arranged on different, in particular opposite, sides of the connection rail.

In this way, the gas burners may be connected to the connection rail on different sides and the space (surface area) on the top sheet can be used more efficiently. "Different sides" sides encompasses opposite sides, sides that are connected via one or more corners etc.

According to a further embodiment, the extraction unit and/or the connection rail extends (in particular protrudes) perpendicularly upwards from the top sheet.

Perpendicularly means that sides (in particular side panels) of the extraction unit and/or the connection rail have an angle of 90 degrees (including deviations of up to 10 or 20 degrees) in relation to the top sheet.

The extraction unit and/or the connection rail may be provided on the top sheet so as to extend away (with its lengthwise dimension) from a user which improves efficient usage of the kitchen surface.

According to a further embodiment, the extraction unit and/or the connection rail is arranged in the center of the top sheet.

This means that the extraction unit and/or the connection rail passes through the center of the top sheet in a top view.

According to a further embodiment, the extraction unit and/or the connection rail is arranged equidistant from opposite edges of the top sheet.

This allows to arrange the gas burners in a space efficient way. Edges can be understood in that way that an edge is a side of the top sheet which limits the gas hob. Equidistant does not necessarily mean that the distances, as seen in the top view, from the extraction unit and/or the connection rail to the opposite edges of the top sheet are exactly the same. Rather, the distances can vary by up to 10 or 20%.

According to a further embodiment, the extraction unit and/or connection rail has at least one power supply socket for connecting electrical devices.

This allows the user to use kitchen appliances on the top sheet—even while cooking on the "other" side of the connection rail, for example.

According to a further embodiment, the top sheet has, at least below the or each gas burner, a continuous flat surface on which a respective gas burner stands.

Again, this makes cleaning easier.

According to a further embodiment, the gas hob comprises pan supports for supporting a pan above each gas burner, at least one pan support being connected to at least one gas burner so as to form a unit which is configured to be lifted off the top sheet as one.

Having such a unit allows easy assembly (or disassembly) when setting up the gas hob (or when it is not used anymore). "Pan" is to understood to comprise any kind of cooking vessel, for example a pan, pot, wok etc. For example, the gas burner and pan support may be connected by a form fit, force fit or adhesive fit.

According to a further embodiment, the at least one pan support is formed integrally with at least one gas burner.

In this case, the pan support and the gas burner are formed from one piece of material (integrally). For example, the pan support and the gas burner are cast as one (from cast iron, for example).

"An" or "one" is not to be understood as limiting to exactly one element but multiple elements may be provided unless otherwise specified.

Further possible implementations or alternative solutions of the invention also encompass combinations—that are not explicitly mentioned herein—of features described above or below with regard to the embodiments. The person skilled in the art may also add individual or isolated aspects and features to the most basic form of the invention.

BRIEF DESCRIPTION OF THE DRAWINGS

Further embodiments, features and advantages of the present invention will become apparent from the subsequent description and dependent claims, taken in conjunction with the accompanying drawings, in which:

DETAILED DESCRIPTION OF EXEMPLARY EMBODIMENTS OF THE PRESENT INVENTION

Figure 1:
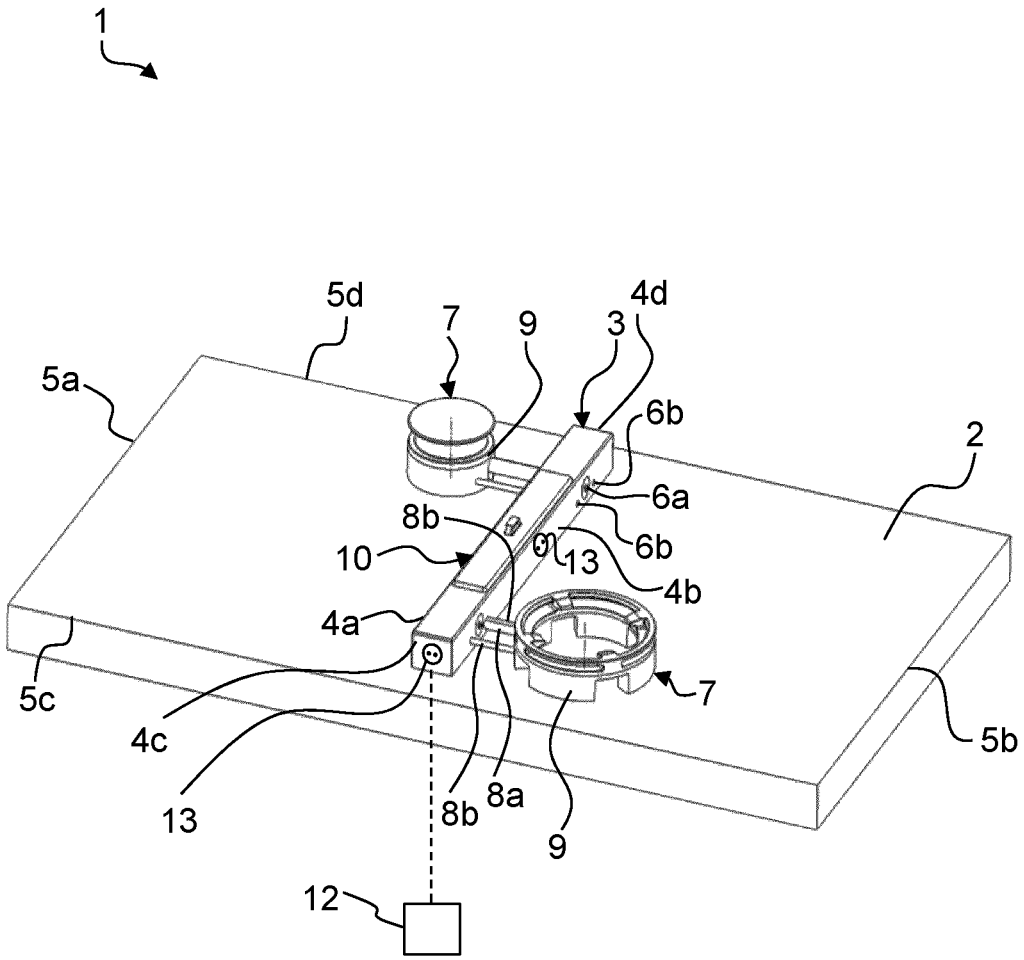
FIGS. 1 to 4 show perspective views of a gas hob according to a first embodiment.

In the Figures, like reference numerals designate like or functionally equivalent elements, unless otherwise indicated.

FIGS. 1 to 4 show, in perspective views, a gas hob 1 according to a first embodiment. The gas hob 1 has a top sheet 2. The top sheet 2 may be of a rectangular shape having short edges 5*a*, 5*b* and long edges 5*c*, 5*d*. The edges 5*a*, 5*b*, 5*c*, 5*d* may limit the area of the gas hob 1.

A connection rail 3 is arranged on the top sheet 2 and, when seen in a top view, passes through its center, for example. In particular, opposing sides 4*a*, 4*b*, 4*c*, 4*d* of the connection rail 3 each have the same distance to opposite edges 5*a*, 5*b*, 5*c*, 5*d* of the top sheet 2 which are parallel to the opposing sides 4*a*, 4*b*, 4*c*, 4*d* of the connection rail 3.

Opposing sides 4*c*, 4*d* of the connection rail 3 are formed as, for example, rectangular end faces. The connection rail 3 has its lengthwise direction in a direction perpendicular to the long edges 5*c*, 5*d* of the top sheet 2 (long sides 4*a*, 4*b* of the connection rail 3 parallel to the short edges 5*a*, 5*b* of the top sheet 2). This allows placement of gas burners 7 (as will be explained in more detail later) to the left and right of the connection rail 3 when standing in front of the long side 5*c* (or 5*d*) of the top sheet 2, i.e. when cooking. The sides 4*a*, 4*b*, 4*c*, 4*d* are, preferably, oriented perpendicularly to the top sheet 2, thus extending upwards therefrom. In embodiments where the connection rail 3 is configured to be retractable into the top sheet 2 (see below), this applies only to the extended state of the connection rail 3, of course.

The connection rail 3 has ports 6*a*, 6*b* to connect gas burners 7 thereto. The ports 6*a*, 6*b* are arranged on different sides 4*a*, 4*b*, especially on opposite sides, of the connection rail 3. Thus, at least one, preferably 2, 3 or more gas burners 7 can be arranged on either side of the connection rail 3. For example, the ports 6*a* are configured to supply fuel-gas, whereas the ports 6*b* supply electrical power for an ignitor (not shown) of the gas burner 7. Or also port 6*b* can carry an electrical flame detection signal (e.g. from a thermocouple) to keep the gas regulation valve open.

Figure 3:
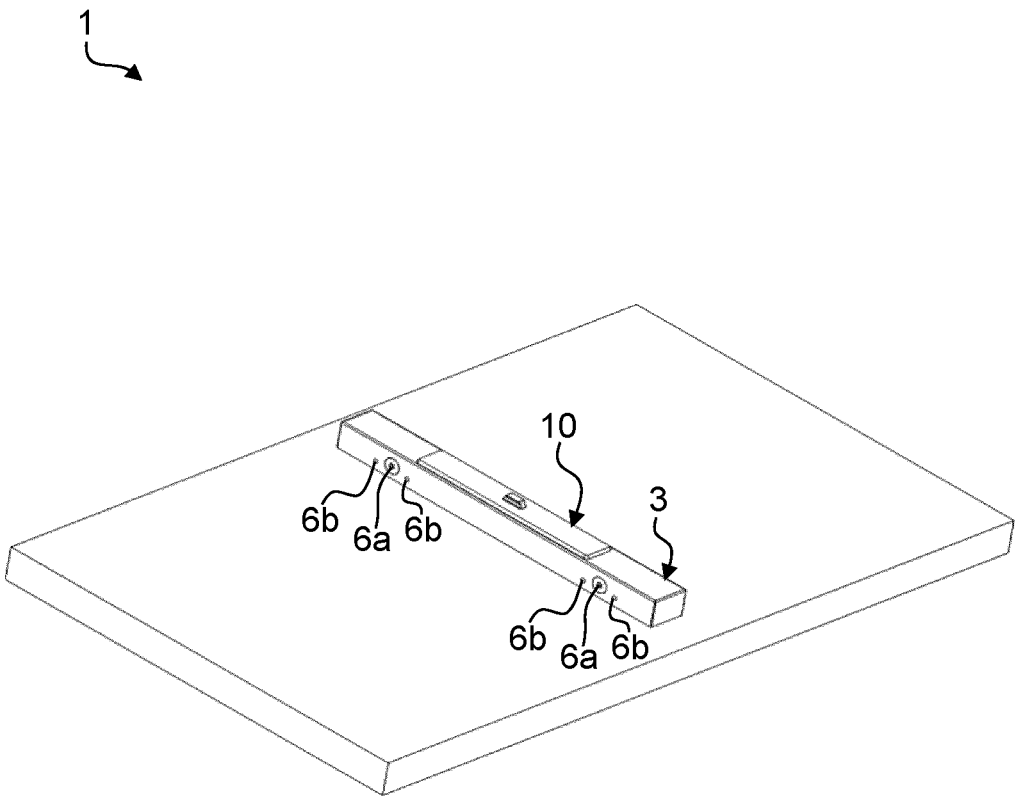

In FIG. 3, the gas burners 7 are disconnected, and ports 6*a*, 6*b* on the left-hand side of the connection rail 3 are shown (in addition to the ports 6*a*, 6*b* seen on the right-hand side in FIG. 1).

For example, as shown in FIG. 1 each gas burner 7 is connected to one (gas) port 6*a* and two ports 6*b* (for electricity) of the connection rail 3. The gas burners 7 are provided with the fuel-gas-air-mixture through a respective pipe 8*a* via a respective port 6*a*. Two ignition connectors 8*b* connect each gas burner 7 to the ports 6*b*. The ignition connectors 8*b* are connected to an ignitor (not shown) inside each gas burner 7 configured to ignite the fuel-gas-air-mixture.

In another embodiment, there are provided two struts 8*b* (instead or in addition to the ignition connectors or the ignition connectors may be integrated into the struts 8*b*) per gas burner 7 and fixedly connected thereto at one end. At the other end, each strut 8*b* engages a respective hole or pocket 6*b* (not or not exclusively a port in this case) formed inside the connection rail 3. By way of the struts 8*b*, the gas burners 7 may be prevented from moving inadvertently on the top sheet 2, i.e. the gas burners 7 are secured in the horizontal plane.

For example, the gas burners 7 each stand on a continuous flat surface 2*a* (see FIG. 4) of the top sheet 2. In fact, the entire surface of the top sheet 2 may be formed as one continuous flat surface 2*a*. When the gas burners 7 are not needed by the user, they can be disconnected from the ports 6*a*, 6*b* to create more free space on the top sheet 2.

Further, each gas burner 7 may be associated with a pan support 9 to support a pan. The pan support 9 may be formed integrally with the gas burner 7 or be a separate element which can be connected to the gas burners 7 to form a unit therewith which can be handled as one. The gas burners 7 may be of the same or different kind—the latter case being shown in FIG. 1.

Figure 2:
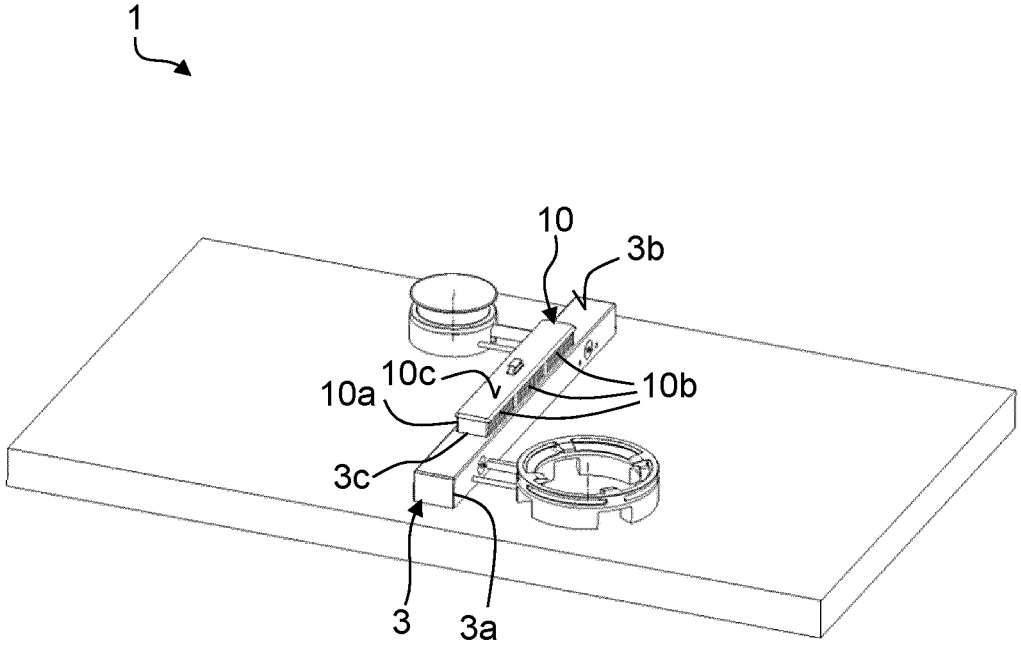

Furthermore, the gas hob 1 comprises, for example, an extraction unit 10 arranged partially (extended state, FIG. 2) or fully (retracted state FIGS. 1, 3 and 4) inside the connection rail 3. In FIG. 1, the extraction unit 10 is retracted into the connection rail 3 (for example when the gas hob 1 is not in use). FIG. 2 shows the extraction unit 10 extended from the connection rail 3 (for example when cooking). In operation, the extraction unit 10 extracts fumes from the cooking area. The extraction unit 10 may be configured to remove gases from above the top sheet 2 to a location under the top sheet 2 (so called downdraft extraction unit). The extraction unit 10 can be retracted into the connection rail 3 and extended therefrom using an electric motor or pneumatic system (not shown), for example.

According to the first embodiment, the extraction unit 10 has a housing 10*a* (see FIG. 2) which, at least in the extended position of the extraction unit 10, extends upwardly through an opening 3*c* formed inside a top surface 3*b* of a housing 3*a* of the connection rail 3. In the extended state, openings 10*b* of the housing 10*a* are exposed through which fumes are drawn in from the cooking area. The openings 10*b* may face the towards the gas burners 7 to one side (or both sides) of the connection rail 3.

In the retracted state (FIGS. 1, 3 and 4), the housing 10*a* may still (slightly) protrude above the top surface 3*b*. The reason for this may be to provide improved sealing between the housing 10*a* and the opening 3*c* in the top surface 3*b*. Or, a top surface 10*c* of the housing 10*a* (extraction unit 10) may be flush with the top surface 3*b* of the housing 3*a* (connection rail 3).

Figure 4:
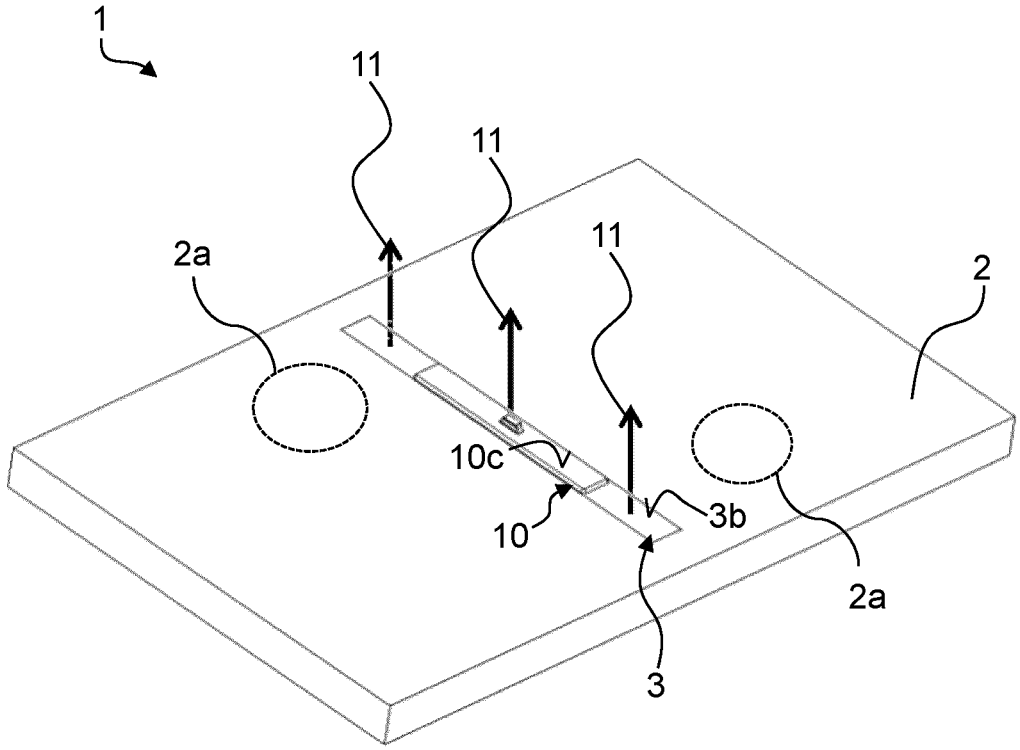

FIG. 4 shows the gas hob 1 with the connection rail 3 in a retracted state, wherein the connection rail 3 is retracted completely into the top sheet 2. Preferably, the top surface 3*b* of the retracted connection rail 3 is flush with the top sheet 2. The retracted extraction unit 10 and the retracted connection rail 3 form a substantially flat area on the top sheet 2 in FIG. 4.

When the user starts cooking, the connection rail 3 can be extended upwardly from the top sheet 2 (which is shown by arrows 11) using drive means 12, for example an electric motor, or by hand. The connection rail 3 may extend upon a user input, for example, via a touch screen (not shown) controlling the drive means 12. Or, the connection rail 3 may extend automatically when the user turns on a stand-by mode of the gas hob 1. Of course, the connection rail 3 may be retracted, for example after cooking, through user input (e.g. via the touch screen) or by hand.

Returning to FIG. 1, the connection rail 3 may comprise one or more sockets 13 for electrically connecting kitchen appliances or other electrical devices (i.e. the sockets supply electrical power, for example at 220 Volts). The sockets 13 may be arranged on different sides 4*b*, 4*c* of the connection rail 3. In embodiments where the connection rail 3 is configured to be retractable into the top sheet 2, the sockets 13 move along with the connection rail 3, and are thus also hidden in the retracted state of the connection rail 3.

Figure 5:
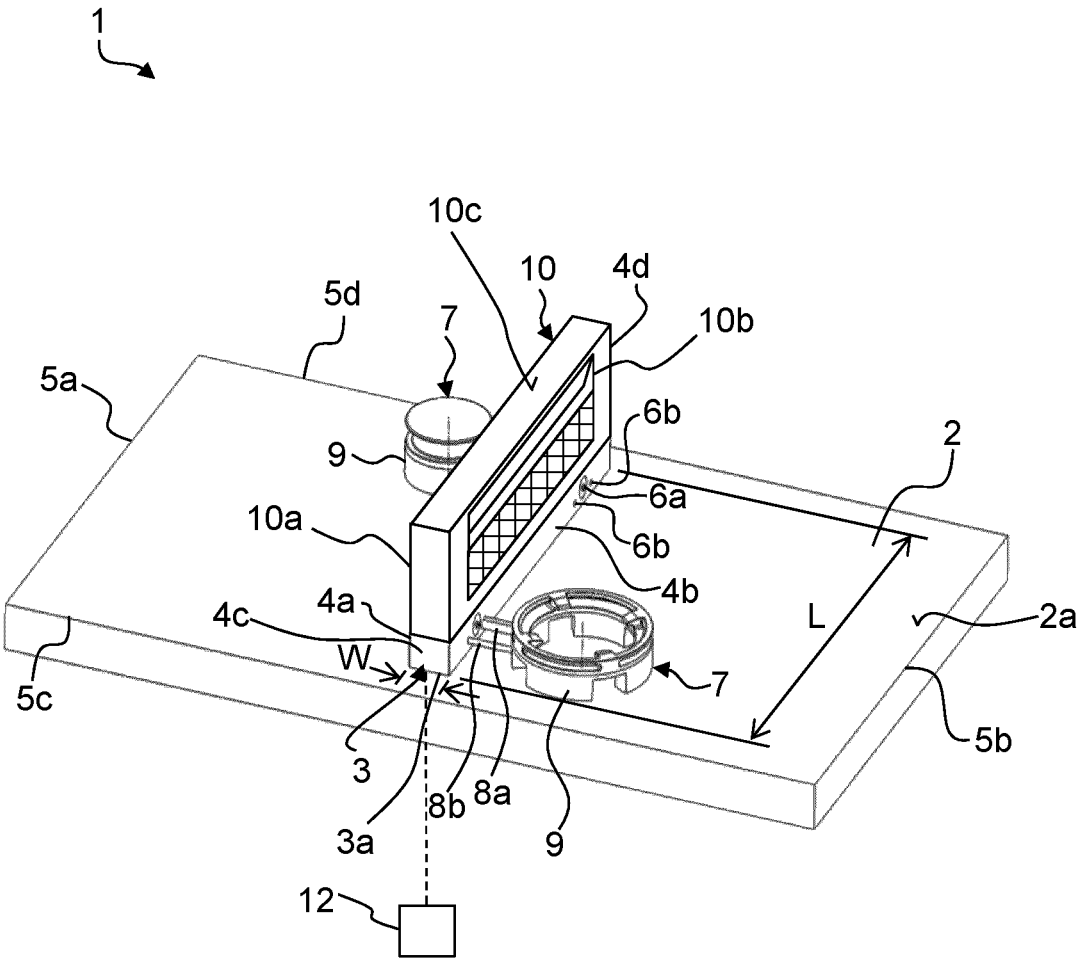
FIGS. 5 and 6 show perspective views of a gas hob according to a second embodiment.
Figure 6:
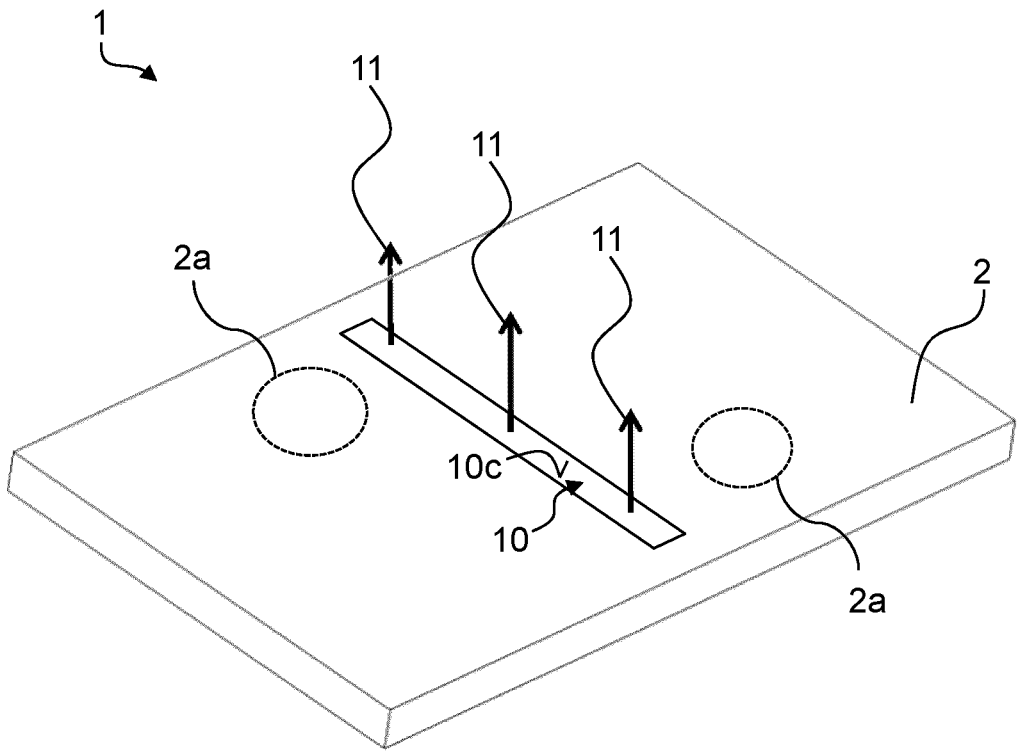

FIGS. 5 and 6 show, in perspective views, a gas hob 1 according to a second embodiment. As seen in FIG. 5, the connection rail 3 and the extraction unit 10 comprise respective housings 3*a*, 10*a*, the housings 3*a*, 10*a* being fixedly connected to each other. Alternatively, the connection rail 3 and the extraction unit 10 may be integrated into one and the same housing.

The extraction unit 10 is, in the example of FIG. 5, arranged on top of the connection rail 3. The housing 10*a*, having the same width W and length L as the housing 3*a*, extends the housing 3*a* in the perpendicularly upwards direction. The combined shape of the housings 10*a* and 3*a* is, thus, a cylinder with a rectangular base area. The extraction unit 10 has, on one or both of its sides facing the gas burners 7, a slit-shaped opening 10*b* for drawing in fumes from the cooking area.

According to the second embodiment, the extraction unit 10 is retracted along with the connection rail 3 into the top sheet 2 by way of drive means 12. FIG. 6 shows the retracted state of both, the extraction unit 10 and the connection rail 3. In the retracted state, an upper surface 10*c* of the extraction unit 10 is flush with the top sheet 2, forming a flat surface therewith.

Analogously, the extraction unit 10 and the connection rail 3 may be extended again by the drive means 12.

The power supply sockets 13 may, in addition or alternatively, provided on the extraction unit 10 (not shown).

Figure 7:
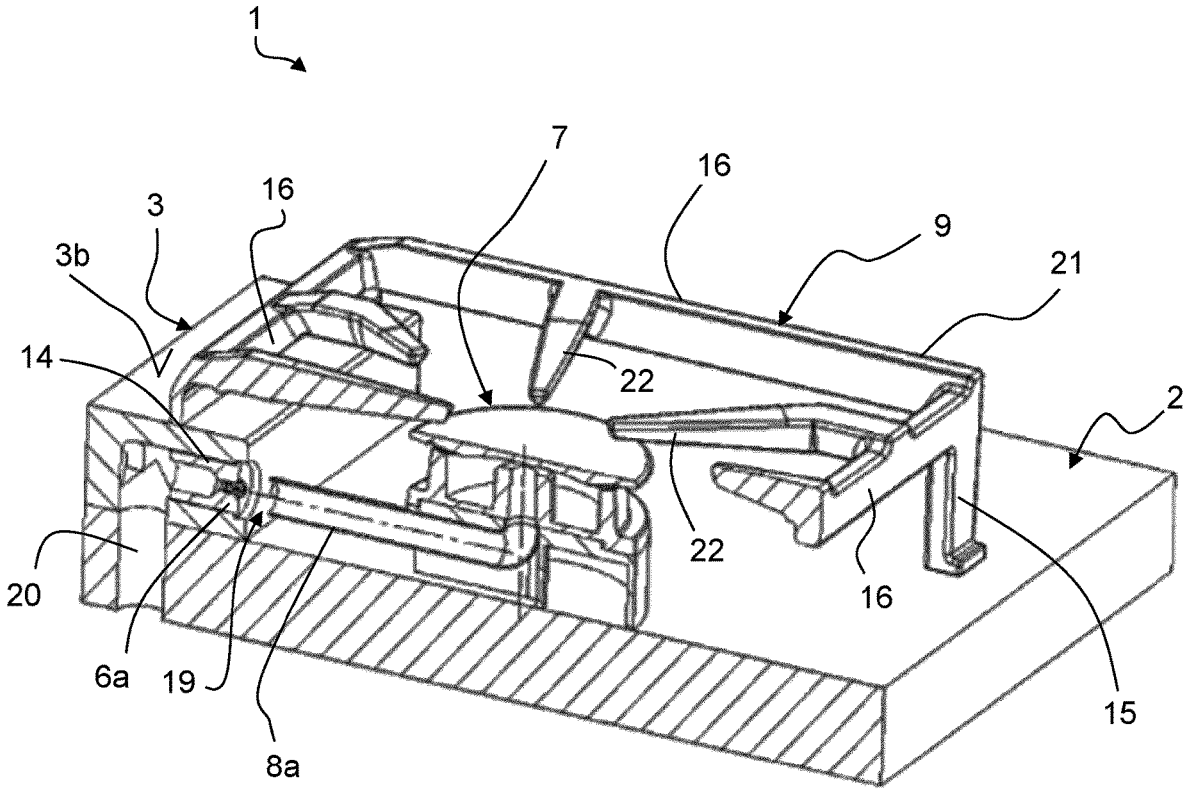
FIGS. 7 and 8 show perspective views of a gas hob according to a third embodiment.
Figure 8:
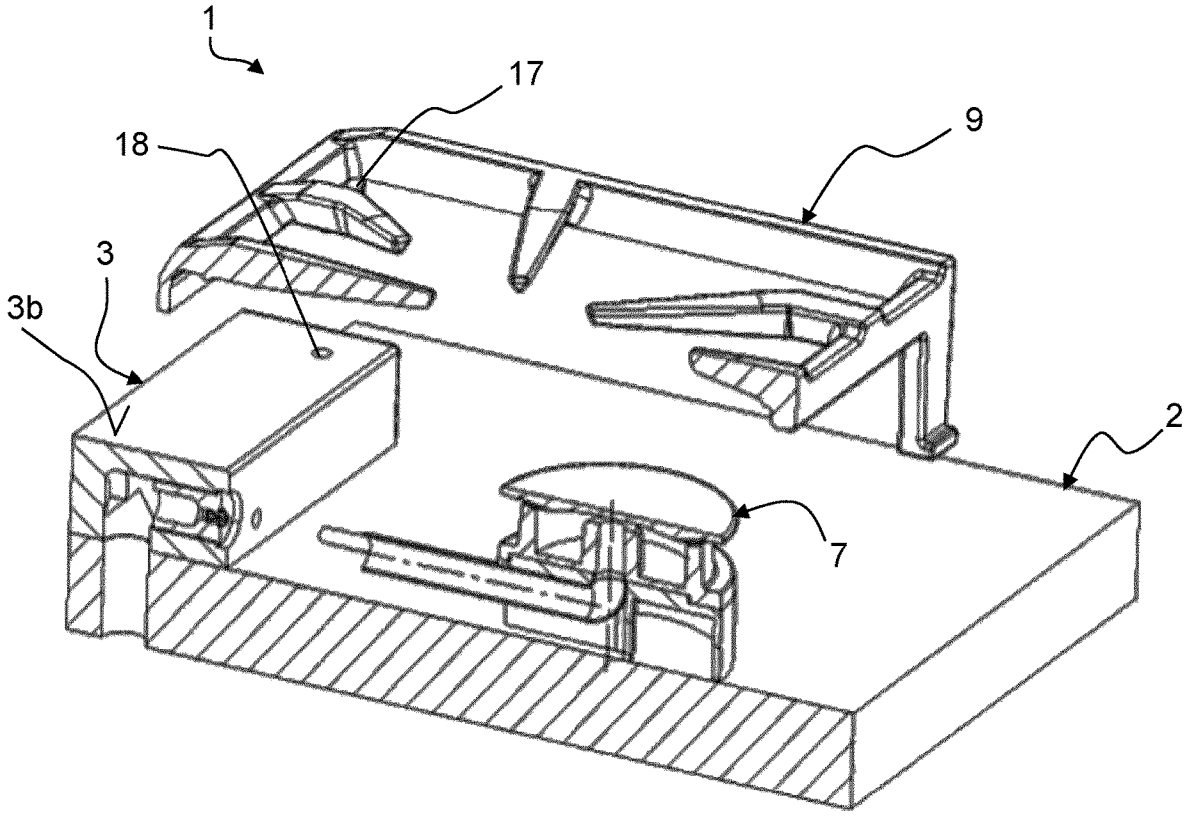

FIGS. 7 and 8 show, in perspective section views, a gas hob 1 according to a third embodiment. The third embodiment may have any of the features of the first and second embodiment.

The third embodiment illustrates that an injector 14 may be integrated into the port 6*a*, thus injecting fuel gas into the pipe 8*a*. The injector 14 is supplied with the fuel gas by a channel 20 inside the connection rail 3 and the top sheet 2. A gap 19 may be formed between the injector 14 and the pipe 8*a* through which primary air is drawn in and mixed with the fuel gas forming a combustible fuel-gas-air-mixture.

Also, FIGS. 7 and 8 illustrate that the pan support 9 and the gas burner 7 are provided as separate components which are not connected to each other (as opposed to the first and second embodiment).

Further, the pan support 9 may comprise a frame 21 composed of frame members (e.g. bars) 16. The pan support 9 rests with one frame member 16 on a top surface 3*b* of the connection rail 3. As can be seen in FIG. 8, a downwards pointing protrusion (e.g. a pin) 17 formed on the one frame member 16 engages a recess 18 in the top surface 3*b* in the vertical direction, securing the pan support 9 on the connection rail 3 in the horizontal direction. A leg 15 is provided on a frame member 16 opposite the frame member 16 resting on the top surface 3*b*. The leg 15 reaches down towards the top sheet 2 and rest thereon. Fingers 22 reach from the frame 21 inwards to provide a surface to support the pan above the gas burner 7. Even though not shown in FIGS. 7 and 8, another pair of a protrusion 17 (and corresponding recess 18) and a leg 15 may be formed symmetrically with respect to the cross-sectional plane on the frame 21.

As can be seen in FIG. 8, the pan support 9 can be removed (completely) from the top sheet 2, and also independent of the gas burner 7.

Although the present invention has been described in accordance with preferred embodiments, it is obvious for the person skilled in the art that modifications are possible in all embodiments.

The invention claimed is:

1. A gas hob, comprising:

a top sheet;

a port;

a gas burner arranged on the top sheet and releasably connected to the port, with the port being configured to supply the gas burner with fuel gas;

a connection rail being retractable into the top sheet; and an extraction unit configured to extract fumes, said extraction unit being retractable into the top sheet.

2. The gas hob of claim 1, wherein the extraction unit is a downdraft extraction unit.

3. The gas hob of claim 1 or 2, wherein the top sheet and the extraction unit, in its retracted state, form a flat surface.

4. The gas hob of claim 1, further comprising a drive configured to retract the extraction unit into the top sheet.

5. The gas hob of claim 1, wherein the extraction unit is configured to allow retraction thereof by hand into the top sheet.

6. The gas hob of claim 1, wherein the connection rail includes the port, and wherein the gas burner is arranged on the top sheet and releasably connected to the port, the port being configured to supply the gas burner with fuel gas.

7. The gas hob of claim 6, wherein the extraction unit is arranged at least one of:

on top of the connection rail; and at least partially inside the connection rail.

8. The gas hob of claim 6, wherein the extraction unit and the connection rail are fixedly connected to each other.

9. The gas hob of claim 6, wherein the extraction unit is retractable into the connection rail.

10. The gas hob of claim 6, wherein the port comprises a plurality of ports and the gas burner comprises a plurality of gas burners, wherein the connection rail includes the plurality of ports, wherein the plurality of gas burners are arranged on the top sheet and releasably connected to the plurality of ports, the plurality of ports being configured to supply the plurality of gas burners with the fuel gas, and wherein the plurality of ports are arranged on different sides of the connection rail.

11. The gas hob of claim 6, wherein the port comprises a plurality of ports and the gas burner comprises a plurality of gas burners, wherein the connection rail includes the plurality of ports, wherein the plurality of gas burners are arranged on the top sheet and releasably connected to the plurality of ports, the plurality of ports being configured to supply the plurality of gas burners with the fuel gas, and wherein the plurality of ports are arranged on opposite sides of the connection rail.

12. The gas hob of claim 6, wherein at least one of the extraction unit and the connection rail extends perpendicularly upwards from the top sheet.

13. The gas hob of claim 6, wherein at least one of the extraction unit and the connection rail is arranged in the center of the top sheet and/or wherein at least one of the extraction unit and the connection rail is arranged equidistant from opposite edges of the top sheet.

14. The gas hob of claim 6, wherein at least one of the extraction unit and the connection rail includes a power supply socket for connecting electrical devices.

15. The gas hob of claim 1, wherein the top sheet has, at least below the gas burner, a continuous flat surface on which the gas burner stands.

16. The gas hob of claim 1, further comprising a pan support for supporting a pan above the gas burner, said pan support being connected to the gas burner so as to form a unit which is configured to be lifted off the top sheet as one.

17. The gas hob of claim 1, further comprising a pan support for supporting a pan above the gas burner, said pan support being formed integrally with the gas burner.

18. The gas hob of claim 1, wherein the extraction unit is retractable into the connection rail, and wherein the connection rail and the extraction unit are retractable into the top sheet.

19. The gas hob of claim 1, wherein the extraction unit is arranged at least one of:

on top of the connection rail; and at least partially inside the connection rail, and wherein the connection rail and the extraction unit are retractable into the top sheet.

* * * * *